United States Patent [19]

Cukier et al.

[11] 4,213,867

[45] Jul. 22, 1980

[54] FABRIC CONDITIONING COMPOSITIONS

[75] Inventors: Samuel Cukier; Irshad A. Khan, both of Montreal, Canada

[73] Assignee: Domtar Inc., Montreal, Canada

[21] Appl. No.: 362

[22] Filed: Dec. 29, 1978

[51] Int. Cl.[2] ..... D06M 13/34; D06M 13/46; D06M 13/38

[52] U.S. Cl. ..... 252/8.75; 8/115.6; 252/8.8

[58] Field of Search ..... 252/8.75, 8.8; 8/115.6

[56] References Cited

U.S. PATENT DOCUMENTS

| | | | |
|---|---|---|---|
| 2,742,379 | 4/1956 | Schofield | 252/8.8 |
| 3,349,033 | 10/1967 | Zuccarelli | 252/8.75 |
| 3,578,591 | 5/1971 | Lazaridis et al. | 252/8.75 |
| 3,644,203 | 2/1972 | Lamberti et al. | 252/8.75 |
| 4,018,688 | 4/1977 | Pracht et al. | 252/8.75 |
| 4,141,871 | 2/1979 | McDonald | 252/8.8 |

*Primary Examiner*—Joseph L. Schofer
*Assistant Examiner*—Herbert J. Lilling
*Attorney, Agent, or Firm*—C. A. Rowley

[57] ABSTRACT

The present invention relates to fabric conditioning compositions containing quaternary ammonium compounds and fatty alcohols or phosphoric acid esters thereof, in admixture with a diluent, where the compositions are pumpable at room temperature and are easily dispersed in water.

12 Claims, No Drawings

FABRIC CONDITIONING COMPOSITIONS

FIELD OF THE INVENTION

The present invention relates to fabric conditioning compositions. More particularly, it relates to base mixes for fabric conditioning compositions containing quaternary ammonium compounds which are pumpable at room temperature and easily dispersed in water.

BACKGROUND OF THE INVENTION/PRIOR ART

Fabric conditioning compositions are used to render laundered fabrics smooth to touch and reduce their static cling. The active component in the preponderant number of these compositions is a quaternary ammonium compound. Such quaternary ammonium compounds may be represented by the general formula $(R_1R_2R_3R_4N^{30})X^-$ where $R_1$, $R_2$ represent alkyl groups having 1 to 3 carbon atoms, $R_3$ represents an alkyl group having 12 to 20 carbon atoms, and $R_4$ is chosen from the group consisting of phenyl groups, alkyl groups having 1 to 3 carbon atoms and alkyl groups having 12 to 20 carbon atoms, and where the anion $X^-$ represents chloride, bromide, nitrate, bisulfate, acetate, methylsulfate and ethylsulfate. Typical of this class of compounds would be distearyldimethyl ammonium chloride, stearyltrimethyl ammonium chloride, etc.

The quaternary ammonium compound is normally mixed with a diluent comprising a mixture of a short chain aliphatic alcohol (typically isopropanol) and water (in the proportions ranging from about 4:1 to about 3:1) to form a base mix having a approximately 75% concentration of the compound prior to shipping.

The base mix normally has a high viscosity at operating temperatures, and with a drop in temperature often becomes impossible to pump. This has required the construction of temperature-controlled storage areas to maintain the mix in a fluid state. Despite such measures, which entail some inconvenience, it is often found that upon standing for a period of time (about 2–3 weeks) the base mix has separated into various phases, with a crystalline phase adhering to the container walls. This crystalline phase is hard to remove and not only presents a handling problem to the user but results in a great deal of wastage of a relatively expensive chemical.

Addition of larger quantities of the isopropanol can render the base mix more flowable. However, the formation of the crystalline phase is not inhibited and such an addition, while decreasing the activity of the mix will augment its flammability thereby increasing the fire hazard in handling. Additionally the cost of shipping a given amount of the compound will be increased due to the increased volume of the diluent. On the other hand, if the proportion of water in the diluent component is increased, the base mix will form a gel. Clearly then, merely increasing the proportion of the diluent component does not provide a satisfactory solution to this problem.

Attempts to overcome this problem have been made by synthesizing a new series of quaternary ammonium compounds (Canadian Pat. No. 733,527) which are quite soluble in short chain aliphatic alcohols. However, it is believed that the problem of rendering pumpable the commonly used quaternary ammonium compounds still lacks a satisfactory solution.

Accordingly it is the object of this invention to provide an easily manipulated base mix for a conditioning composition containing a quaternary ammonium compound.

BRIEF DESCRIPTION OF THE INVENTION

The present invention relates to a homogeneous base mix for fabric conditioning compositions, which is pumpable at room temperature and comprises components:

(a) a diluent constituting between about 15 and about 35 percent of the base mix, (b) between about 50 and 80 percent of quaternary ammonium compounds having the general formula $(R_1R_2R_3R_4N^+)X^-$, where $R_1$, $R_2$ represent alkyl groups having 1 to 3 carbon atoms, $R_3$ represents an alkyl group having 12 to 20 carbon atoms, $R_4$ is chosen from the group consisting of alkyl groups having 1 to 3 carbon atoms and alkyl groups having 12 to 20 carbon atoms and where the anion $X^-$ represents a member of the group consisting of chloride, bromide, nitrate, bisulfate, acetate, methylsulfate and ethylsulfate; and (c) a member chosen from the group consisting of:

(i) fatty alcohols having the general formula ROH, where R represents alkyl groups having between 18 and 28 carbon atoms, (ii) phosphoric acid esters having the general formula $$(RO)_m-\overset{\overset{\displaystyle O}{\|}}{P}-(OH)_n,$$

where R represents alkyl groups as defined above, and $m+n=3$ with $m \geqq 1$, (iii) a mixture of c(i) and c(ii), where the proportion of component (c) in the base mix ranges from about 5 to 25 percent, so as to provide the homogeneous base mix for fabric conditioning compositions, which is pumpable at room temperature.

DETAILED DESCRIPTION OF THE INVENTION

As noted earlier, the present invention relates to a base mix for fabric conditioning compositions. These compositions contain a quaternary ammonium compound, a fatty alcohol and/or phosphate ester thereof, and the diluent normally composed of a short chain aliphatic alcohol having less than 4 carbon atoms (typically isopropanol) and water. Compared to the composition of the base mix which is normally used, the concentration of the diluent in the present composition is substantially unchanged, while the total concentration of the quaternary ammonium compound and the fatty alcohol and/or the phosphate ester is substantially the same as the concentration of the quaternary ammonium compound in the original base mix. Therefore the present composition is the result of substitution in the base mix of limited quantities of the fatty alcohol and/or the phosphate ester for equal amounts of the quaternary ammonium compound.

The new base mix of the present composition contains about 15–35% diluent preferably between about 20 and 30%, normally about 25% and typically composed of 20% short chain alcohol and 5% water. Of the other 65–85%, between 5 and 25% of the base mix will be composed of the fatty alcohol and the remaining 40–80% by the quaternary ammonium compound, if the fatty alcohol is used. Preferably, the base mix will be composed of between about 20 to 30% diluent, about 5 to 20% fatty alcohol and between about 50 to 75% quaternary ammonium compound. If the phosphate ester is used, between 10 and 30% of the base mix will be composed of the phosphate ester and the remaining 35–75% by the quaternary ammonium compound. Preferably, the base mix will be composed of between about 20 to 30% diluent, between about 10 to 30% phosphate ester and about 50 to 60% quaternary ammonium compound. Minor variations from these proportions may be necessary depending on the exact combination quaternary ammonium compound and the fatty alcohol or phosphate ester used.

The base mix will normally be prepared by melting together with agitation, the appropriate proportions of the quaternary ammonium compound, the fatty alcohol and/or phosphate ester admixed with the diluent. Such compositions, it is found, are quite homogeneous and easily pumpable at normal storage temperatures (about 10°–20° C.) and eliminate the need for temperature-controlled rooms and other specialized equipment to keep the base mix in a pumpable state. The base mix, can be diluted with water to form an aqueous emulsion of 2–10% concentration (based on quaternary ammonium compound and fatty alcohol or phosphate ester). The base mix will be at or slightly above the normal storage temperature when added to the water which will be between about 40° and 60° C., so as to promote dispersion. This emulsion is found to possess substantially the same fabric conditioning properties as emulsions (of the same concentration) derived from the usual base mix having a quaternary ammonium compound concentration of 75%, and will normally be used as a rinse cycle added softener.

The lower limit of addition of the fatty alcohol or phosphate ester (or mixtures thereof) to the base mix represents the lowest level of addition which provides a homogeneous pumpable mix, while the upper limit represents the maximum proportion of the fatty alcohol or phosphate ester (or the mixture) permissible in the base mix without significant deterioration in its fabric conditioning ability.

The fatty alcohols used in the present invention can be represented by the general formula ROH, where R represents an alkyl group having 18 to 28 carbon atoms. The alcohols may be used in this composition either singly or as mixtures. The preferred fatty alcohols for use are those having 20 to 24 carbon atoms, or more generally, alcohol mixtures having an average chain length between 20 and 24 carbon atoms.

The phosphate esters contemplated for use in this invention can be represented by the general formula $$(RO)_m-\overset{\overset{\displaystyle O}{\|}}{P}-(OH)_n .$$

In this formula R represents an alkyl group having between 18 and 28 carbon atoms, and where the sum of m and n is three, and where m is at least one. Such esters are normally prepared by reacting fatty alcohols, such as those described earlier, with phosphoric acid, phosphorous pentoxide, phosphorus oxychloride, or polyphosphoric acid. Mixtures of fatty alcohols can also be used in the preparation of the esters. The preferred esters for use in this invention are monoalkyl esters derived from alcohols having 20 to 24 carbon atoms, or more generally from fatty alcohol mixtures having an average chain length between 20 and 24 carbon atoms. The phosphate esters will normally be in the free acid form in the base mix. However they will normally be neutralised with alkali in the preparation of the fabric conditioning composition emulsions.

The quaternary ammonium compound used in this composition is the same as that used in the original base mix. It can be represented by the general formula $(R_1R_2R_3R_4N^+)X^-$ where $R_1$, $R_2$ represent alkyl groups having 1 to 3 carbon atoms, $R_3$ represents an alkyl group having 12 to 20 carbon atoms and $R_4$ is chosen from alkyl groups containing 1 to 3 carbon atoms and alkyl groups having 12 to 20 carbon atoms, and where the anion $X^-$ represents chloride, bromide, nitrate, bisulfate, acetate, methylsulfate and ethylsulfate. Particularly preferred for use in this composition are quaternary ammonium compounds where $R_1$ and $R_2$ represent methyl groups, and $R_3$ and $R_4$ represent stearyl groups, and $X^-$ represents the chloride.

It is indeed surprising that the mixture of two chemicals each of which is highly viscous at room temperature results in a composition which is homogeneous, easily pumpable and sometimes even quite fluid. The base mix is relatively homogeneous and stable over reasonable periods of time. Additionally, the proportion of water in the diluent component may be increased about 3–5% (based on the base mix) without danger of gel formation, thereby further reducing the cost of the base mix without any deleterious effects. The fatty alcohols or phosphate esters by themselves are not normally considered to have much fabric conditioning ability, however when they are used in limited quantities in a mixture with the quaternary ammonium compound provide compositions which have fabric conditioning ability substantially equivalent to those derived from the pure quaternary ammonium compounds. Since the fatty alcohols or phosphate esters usually cost a fraction of the price of the quaternary ammonium compound they replace, such a mixture is also desirable on economic grounds.

The following examples illustrate some embodiments of the present invention

EXAMPLE 1:

This example describes the preparation of compositions containing quaternary ammonium compounds and phosphate esters, which are homogeneous, pumpable and demonstrate fabric conditioning ability. These compositions contain 25% diluent (about 8% percent water and about 17% isopropanol) and 75% quaternary ammonium compound plus phosphate ester. The quanternary ammonium compound used in this example was distearyldimethyl ammonium chloride, sold under the trademark Arquad 2HT by Armak Chemical Ltd. while the phosphate esters were phosphoric acid esters of an alcohol mixture containing about 65% $C_{18}$-$C_{22}$ alcohols (the remainder being $C_{20}$-$C_{40}$ hydrocarbons) sold under the trademark Epal C20+, by Ethyl Corporation. The Epal C20+ was esterified by reacting polyphosphoric acid with the alcohol mixture: the resultant composition containing predominantly the monoester. The ester, the quaternary ammonium compound, and the diluent (in quantities indicated in Table I A below) components of the base mix were heated together with mixing until a clear melt of the base mix was obtained. Upon cooling to room temperature, the base mix was found to be more fluid than the base mix containing 75% Arquad 2HT(TM). The base mix composition was melted and poured into an aqueous solution of caustic soda which contained the alkali in a quantity sufficient to neutralise the acid content of the phosphate ester and enough water to provide an approximately 5% emulsion of the quaternary ammonium compound and phosphate ester salt, a concentration typical of commercial fabric conditioning formulations.

These emulsions were tested for their fabric softening ability as follows: A 10 g. swatch of washed terry cloth was stirred in a liter of water containing 0.3 g of the 5% emulsion. After 5 minutes of rinsing, the swatch was squeezed, dried at about 60° C. for 15–20 minutes and ironed. This procedure was repeated using control emulsions of Arquad 2HT (TM) at a 5% concentration and a commercial fabric softener, (Le Parisien (TM) of Lavo Co.), which was an about 5% emulsion of mixture of quaternary ammonium and imidazolinium compounds. The terry cloth swatches rinsed with each of the emulsions derived from the present invention compositions were ranked according to their softness by a panel of 10 people relative to the swatches rinsed with the control emulsions. Each member of the panel assigned the swatches from 1 to 3 points with 1 representing the softest and 3 the roughest. The points awarded each swatch by the panel members were added up and the softness ranking test are shown in Table I B below. The three numbers in each of the of Table I B denote the sum of the softness rankings awarded each swatch raised with emulsions containing each of the present invention compositions (of runs 1–6 respectively) the quaternary ammonium compound (composition of run A) and of the commerical fabric softener (Le Parisien (TM)), respectively. It can be seen, when concentrations of phosphate ester between 10 and 25% (of the base mix) were employed, it demonstrated an ability to soften fabrics which was substantially equivalent to that of the unmodified quaternary ammonium compound composition. However when too little ester was employed the base mix maintained its crystalline structure (eg. run 1), while addition of large quantities (eg. run 6) resulted in a rougher swatch.

TABLE I B-continued

COMPARATIVE RATINGS OF FABRIC SOFTENING ABILITY

| Run No. | 1 | 2 | 3 | 4 | 5 | 6 |
|---|---|---|---|---|---|---|
| Sum of fabric softness ratings of present Invention formulations | 18 | 15 | 16 | 18 | 19 | 20 |
| Sum of fabric softness ratings of control formulation (formulation A) | 15 | 16 | 15 | 15 | 14 | 15 |
| Sum of fabric softness ratings of commercial softener formulation (Le Parisien (TM) | 27 | 29 | 29 | 27 | 27 | 25 |

EXAMPLE 2

The present example describes the preparation of a base mix for fabric conditioning compositions containing quaternary ammonium compound, fatty alcohols and diluent. The diluent was substantially the same as that employed in the preceding example and comprised about 25% diluent (about 8% water and 17% isopropanol) and 75% quaternary ammonium compound Arquad 2HT (TM) and the fatty alcohol Epal C20+ (TM) in varying proportions. The exact composition of the mixtures is indicated below in Table II A. The base mix was prepared by heating the ingredients with mixing until a clear melt was obtained. Upon cooling to room temperature, the base mix was softer and more homogeneous than the base mix containing 75% by weight of Arquad 2HT (TM). To prepare the 5% emulsion, the base mix was melted and mixed with water in which it was readily dispersible. The emulsions resulting from the various base mixes were then evaluated for their fabric softening ability relative to the control solutions in a manner substantially identical to that described in Example 1. The results of these tests are described in Table II B below. It will be readily noted from the table, that substitution of the fatty alcohol for a portion (viz. between 5 and 20% of the base mix) of the quaternary ammonium compound resulted in a homogeneous, base mix, which was easily pumped at room temperature, and yielded an emulsion with acceptable fabric softening properties.

It will be evident to the person skilled in the art that modifications can be made to the above, which will be within the scope of the appended claims.

TABLE I A

| INGREDIENTS | EXPERIMENTAL RUN NO./WEIGHT PERCENT | | | | | | |
|---|---|---|---|---|---|---|---|
| NO. | A | 1 | 2 | 3 | 4 | 5 | 6 |
| 1. Arquad 2HT(TM) | 75.0 | 70.0 | 65.0 | 60.0 | 55.0 | 50.0 | 45.0 |
| 2. Phosphate Ester | 0.0 | 5.0 | 10.0 | 15.0 | 20.0 | 25.0 | 30.0 |
| 3. Isopropanol | 17.0 | 17.0 | 17.0 | 17.0 | 17.0 | 17.0 | 17.0 |
| 4. Water | 8.0 | 8.0 | 8.0 | 8.0 | 8.0 | 8.0 | 8.0 |
| TOTAL | 100 | 100 | 100 | 100 | 100 | 100 | 100 |
| Fluidity of base mix at room temperature | Hard paste with crystalline phase | Soft paste with crystalline phase | Soft homogeneous paste | Softer than 2 | Softer than 3 | Like 4 | Harder than 5 |

TABLE I B

COMPARATIVE RATINGS OF FABRIC SOFTENING ABILITY

Experimental

TABLE II A

| NO. | INGREDIENTS | EXPERIMENTAL RUN NO./WEIGHT PERCENT | | | | | |
|---|---|---|---|---|---|---|---|
| | | A | 1 | 2 | 3 | 4 | 5 |
| 1. | Arquad 2HT(TM) | 75.0 | 70.0 | 65.0 | 60.0 | 55.0 | 50.0 |
| 2. | Epal C20+(TM) alcohol | 0.0 | 5.0 | 10.0 | 15.0 | 20.0 | 25.0 |
| 3. | Isopropanol | 17.0 | 17.0 | 17.0 | 17.0 | 17.0 | 17.0 |
| 4. | Water | 8.0 | 8.0 | 8.0 | 8.0 | 8.0 | 8.0 |

TABLE II A-continued

| NO. | INGREDIENTS | EXPERIMENTAL RUN NO./WEIGHT PERCENT A | 1 | 2 | 3 | 4 | 5 |
|---|---|---|---|---|---|---|---|
| | TOTAL | 100 | 100 | 100 | 100 | 100 | 100 |
| | Fluidity of base mix at room temperature | Hard paste with crystalline phase | Softer homogeneous paste | Softer than 2 | Softer than 3 | Like 4 | Harder than 5 |

TABLE II B

COMPARATIVE RATINGS OF FABRIC SOFTENING ABILITY

| Experimental Run No. | 1 | 2 | 3 | 4 | 5 |
|---|---|---|---|---|---|
| Sum of fabric softness ratings of present invention formulations | 15 | 15 | 18 | 18 | 20 |
| Sum of fabric softness ratings of control formulation (Formulation A) | 15 | 15 | 15 | 15 | 15 |
| Sum of fabric softness ratings of commercial softener formulation (Le Parisien (TM)) | 30 | 30 | 27 | 27 | 25 |

We claim:

1. A homogeneous basic mix for fabric conditioning compositions pumpable at room temperature consisting essentially of:

(a) diluent consisting between about 15 and 35 percent by weight of the base mix, (b) between about 50 and 60 percent by weight of quaternary ammonium compounds having the general formula $(R_1R_2R_3R_4N^+)X^-$ where $R_1$, $R_2$ represent alkyl groups having 1 to 3 carbon atoms, $R_3$ represents an alkyl group having 12 to 20 carbon atoms, $R_4$ is chosen from the group consisting of alkyl groups having 1 to 3 carbon atoms and alkyl groups having 12 to 20 carbon atoms; and where the anion $X^-$ represents chloride, bromide, nitrate, bisulfate acetate, methylsulfate and ethylsulfate; and (c) a member chosen from the group consisting of:

(i) fatty alcohols having the general formula ROH, where R is chosen from alkyl groups having between 18 and 28 carbon atoms, (ii) phosphoric acid esters having the general formula $$(RO)_m-\overset{\overset{\displaystyle O}{\|}}{P}-(OH)_n,$$

where R is chosen as defined in (i) above, and $m+n=3$ with $m \geqq 1$, (iii) a mixture of (c) (i) and (c) (ii), where the weight proportion of component (c) in the base mix can range from about 5 to 30 percent, so as to provide said homogeneous base mix for fabric conditioning compositions, which is pumpable at room temperature.

2. Base mix as defined in claim 1, where substituents on said component (b) are as follows: $R_1$, $R_2$ represent methyl groups, and $R_3$, $R_4$ represent stearyl groups.

3. Base mix as defined in claim 1 where substituent R on said component (c) represents alkyl groups having an average length of between 20 and 24 carbon atoms.

4. Base mix as defined in claim 1, wherein said diluent constitutes 20 to 30% of said base mix.

5. Base mix as defined in claims 1, 2 or 3 where said base mix is mixed with water to form a dispersion containing between 2 and 10% of said components (b) and (c).

6. Base mix as defined in claims 2, 3 or 4 where said component (c) is (c) (i) and where said component (i) constitutes between about 5 and 25% of said base mix.

7. Base mix as defined in claims 2, 3 or 4 where said component (c) is (c) (ii) and where said component (ii) constitutes between about 10 and 30% of said base mix.

8. Base mix as defined in claim 3, where said component (c) is chosen from (c) (ii) and (c) (iii) and where $m=1$.

9. Base mix as defined in claims 1, 2 or 3 wherein said diluent comprises isopropanol and water.

10. Base mix as defined in claims 1, 2 or 3, when prepared by melting together said components (b) and (c) in admixture with said diluent.

11. Method for the preparation of a base mix comprising: melting together a mixture consisting essentially of (a) quaternary ammonium compounds having the general formula $(R_1R_2R_3R_4N^+)X^-$ where substituents $R_1$, $R_2$ are chosen from alkyl groups having 1 to 3 carbon atoms, $R_3$ is chosen from alkyl groups having 12 to 20 carbon atoms, $R_4$ is chosen from the group containing alkyl groups having 1 to 3 carbon atoms and alkyl groups having 12 to 20 carbon atoms, and where $X^-$ represents chloride or methylsulfate; (b) (i) a member chosen from the group consisting of phosphoric acid esters having the general formula $$(RO)_m-\overset{\overset{\displaystyle O}{\|}}{P}-(OH)_n$$

where R represents alkyl groups having 18 to 28 carbon atoms, where $m \geqq 1$, and $m+n=3$, and (ii) fatty alcohols having the general formula ROH, where R is chosen as defined in (i) above; in admixture with (c) an inert diluent, thereby to form said base mix.

12. Process as defined in claim 11 where said component (b) is b(i) and comprising the additional step of mixing said base mix with an aqueous solution of alkali, thereby to form an aqueous emulsion of salts of said phosphoric acid esters, and said quaternary ammonium compound.

* * * * *